United States Patent [19]

Mini et al.

[11] Patent Number: 4,978,021

[45] Date of Patent: Dec. 18, 1990

[54] COLLAPSIBLE CONTAINER

[76] Inventors: Anna M. Mini, 3501 Branson Dr., San Mateo, Calif. 94403; Patrick G. Vandenbroeck, 333 Dartmouth, San Carlos, Calif. 94070

[21] Appl. No.: 504,596

[22] Filed: Apr. 4, 1990

[51] Int. Cl.[5] ..... B65D 6/00

[52] U.S. Cl. ..... 220/8; 220/404

[58] Field of Search ..... 220/8, 4 A, 4 C, 83, 220/85 H, 400, 402, 403, 404

[56] References Cited

U.S. PATENT DOCUMENTS

| | | | |
|---|---|---|---|
| 375,498 | 12/1887 | McGuire | 220/8 |
| 1,040,652 | 10/1912 | Douglas | 220/8 |
| 1,436,499 | 11/1922 | Hammond | 220/8 |
| 1,450,279 | 4/1923 | Chick | 220/8 |
| 2,893,167 | 7/1959 | Davidson | 220/8 X |
| 4,116,204 | 9/1978 | Kline | 220/8 X |
| 4,765,579 | 8/1988 | Robbins, III et al. | 220/404 X |

*Primary Examiner*—Steven M. Pollard
*Attorney, Agent, or Firm*—Thomas M. Freiburger

[57] ABSTRACT

A collapsible drinking container is formed of a series of progressively smaller telescoping sections. A top section supports interiorly a pouch or bag of thin-walled plastic which can receive and contain a liquid, a liquid concentrate or a dry concentrate to be mixed with water or another liquid. In a preferred embodiment the container sections are made of paper, in a truncated conical shape, but then can also be made of plastic materials.

10 Claims, 3 Drawing Sheets

COLLAPSIBLE CONTAINER

BACKGROUND OF THE INVENTION

The invention is concerned generally with containers, and in particular the invention relates to an ecologically sound liquid storage and drinking container.

Containers for liquids have taken a variety of different forms and have been produced from glass, metals, treated paper, foamed plastics and hard plastics.

Styrofoam and other plastic containers have come under attack as environmentally unsound and imprudent, primarily because they virtually do not ever break down into simpler substances. Dump sites are becoming overwhelmed by discarded plastic containers, and many of them are difficult to recycle.

Some paper cups are still used, but they generally will not remain structurally intact carrying liquids for appreciable periods of time.

Folding drinking cups formed of telescopically assembled metal or plastic rings have been well known. In a collapsed position, these cups are only slightly taller than a single ring and can be stored compactly. "Boy scout cups" were formerly in wide use. These cups consisted of three or four rigid, tapered conical rings or sections which were progressively larger toward the top of the cup.

No prior collapsible or disposable drinking container has been as versatile in use while still being as environmentally sound as the container of the present invention described below.

SUMMARY OF THE INVENTION

In accordance with the present invention, a foldable or collapsible drinking container is preferably formed of ecologically sound, biodegradable materials except for a very small volume of a plastic film material, such as a food grade polyethylene or polypropylene.

In a preferred embodiment of the invention, the container comprises a plurality of tapered, truncated conical sections fitted together, each having a base and an upper end, with the upper end of one section having a slightly smaller inside dimension than an outside dimension of the base end of the succeeding section above. Each section tapers to a smaller dimension at its top, such that its sections can be collapsed together to height generally the same as that of the lowermost section. The sections can be telescopically opened by pulling upwardly on the uppermost section to form a telescopically expanded container.

A plastic liner is connected to and extends downwardly through the interior of the uppermost section. An opening at the top of the uppermost section is open to the interior of the plastic liner, so that a user of the container can drink liquid contents of the liner from the top of the container.

In preferred embodiments, the collapsible, telescoping sections are formed of a paper material which is quickly degradable. The plastic liner is formed of an extremely small volume of plastic, and it may be about 0.7 mil in thickness, or even thinner, for a container having a capacity of, for example, about six to eight fluid ounces. A suitable means is provided for holding the container in the erected, full-volume position. This means can comprise a close fitting of the sections together, and a degree of taper which will enable the sections to wedge tightly and remain fully telescoped in length except in the case of a deliberate force applied to collapse the container. Alternatively, it may comprise one or more flaps or tabs or abutments on each of the telescoping sections above the lowermost section. These tabs or abutments can be so positioned and of suitable thickness such that when each conical section is pulled axially outwardly from the section below, the tab or abutment snaps out from under the top edge of the lower section, then provides a resisting edge against reclosure of the container. The tab or abutment structure can also help increase the strength and stability of the container section walls.

The invention also encompasses a method for producing the container. The method can involve insertion of the plastic bag or liner in the uppermost truncated conical section, a partial filling of a liquid or powder concentrate into the bag or liner, the application of a cap to the open top of the uppermost section, and a stacking of the series of truncated conical sections, with each next succeeding lower section being placed over the smaller, next higher section. These steps are followed by labeling and sealing and closing of the sections together in the compact form for shipping, distribution and sale.

It is therefore among the objects of the invention to provide an improved ecologically sound container for compact storage and convenient use by a purchaser, and particularly for marketing concentrates which are to have water or other liquid added by the consumer. These and other objects, advantages and features of the invention will be apparent from the following description of preferred embodiments, considered along with the accompanying drawings.

DESCRIPTION OF PREFERRED EMBODIMENTS

Figure 1:
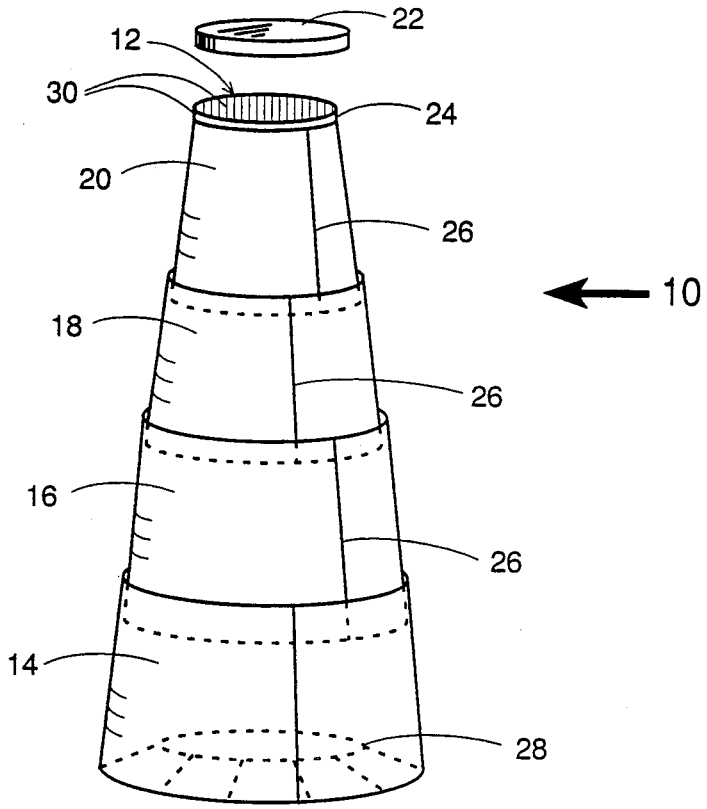
FIG. 1 is a perspective view in elevation showing an erected collapsible container in accordance with the principles of the invention.

In the drawings, FIG. 1 shows one example of a collapsible container 10 constructed in accordance with the principles of the invention. The container 10 is primarily for the drinking of liquids from an open mouth 12 at the upper end of the container, but it can be used for other purposes as well, such as storing of liquids or solids.

Figure 4:
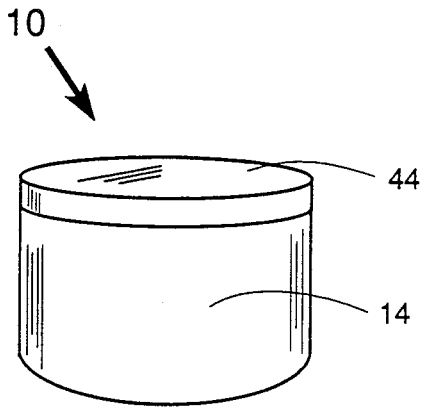
FIG. 4 is another perspective elevation view, showing the container in a collapse and closed configuration, with all sections telescoped together into a lowermost section.

The container 10 is collapsible, to a compact, collapsed configuration shown in FIG. 4. For use it is erected by telescopically opening and extending the container in the position shown in FIG. 1. It is made up of a plurality of sections, each tapered and shaped as a truncated cone. Four sections 14, 16, 18 and 20 are shown in FIG. 1, although more or fewer sections can be used if desired.

As indicated in FIG. 1, each truncated conical section 14–20 tapers to a narrower dimension at its top, a dimension which is slightly smaller than the dimension of the bottom end of the next succeeding section above. The top section 20 of course does not engage any further section above, and a tightly fitting closure cap 22 may provide a closure for the open mouth 12 of the container. The cap 22 may be secured around the open mouth 12 by adhesives or simply by a close interference fit. To this end, the upper edge 24 of the top section 20 can be formed into ar expanded bead as shown in the drawings, such as by rolling the top edge outwardly.

The sections 14–20 in a preferred embodiment are formed of paper material, rolled into the truncated conical shape and seamed together at seams 26. The sections may alternatively be made of a suitable plastic material, but biodegradable paper is preferred, for reasons expressed above. The paper material may be treated with a "wax" (or a very thin degradable plastic coating), similar to the treatment of conventional milk cartons.

In another embodiment the container sections may be formed of an environmentally friendly, biodegradable plastic such as polystyrene. Polystyrene has been found recyclable.

The container 10 preferably has some form of bottom on the lowermost section 14 so that, in the closed, collapsed position shown in FIG. 4, the interior sections 16, 18 and 20 cannot fall through the bottom of the lowermost section 14, which forms a housing or outer wall of the closed container. The bottom can comprise a paper sheet (not shown) secured over the bottom of the section 14, or it can simply comprise a series of inwardly folded tabs 28 at the bottom of the section 14, as indicated in dashed lines in FIG. 1. Such tabs 28, secured in the inwardly folded position, will be sufficient to prevent the inner sections 16, 18 and 20 from escaping. The tabs, preferably integral with the bottom section, can be snapped "over center" when folded inwardly, so as to remain in the inwardly folded position.

Figure 2:
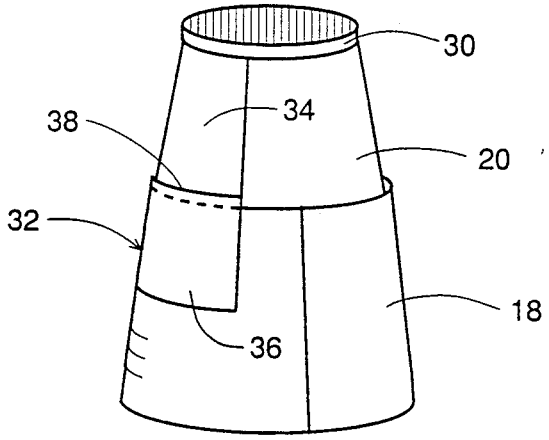
FIG. 2 is a partial view of the container, showing two sections and indicating structure for holding the sections in the erected position.
Figure 3:
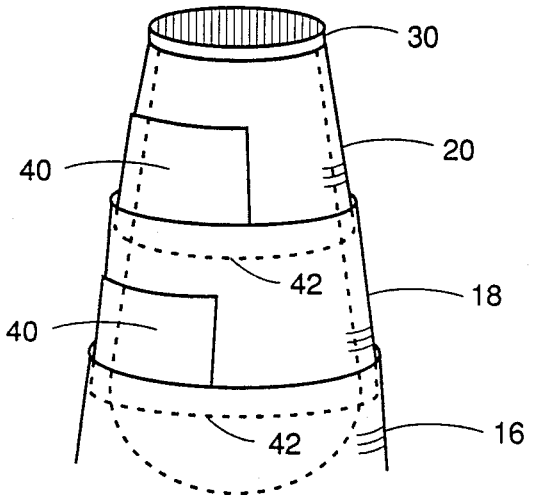
FIG. 3 is a view similar to FIG. 2, but showing an alternate form of structure for holding the sections in the erected position.

As shown in the drawings, an important feature of the invention is the inclusion of a plastic liner 30 in the interior of the container 10. FIGS. 1, 2 and 3 indicate that the plastic liner 30 may extend outwardly and over the top edge 24 of the uppermost section 20, being sealed against the outside of the section 20 at that edge. The plastic liner, as mentioned above, may comprise a food grade polyethylene film seamless bag or liner about 0.7 mil thickness, in the case of a container about six inches in height and with a capacity of about six to eight fluid ounces. Such film is used in some sandwich bags marketed to consumers. In some cases the plastic liner can be even thinner, or for larger and higher-capacity containers, it can be made somewhat thicker. The outer edge of the plastic liner 30 preferably is sealed to the edge of the section 20, about its open mouth 12, by a high-integrity adhesive.

The polystyrene film will break down when properly incinerated, basically into carbon dioxide and water vapor. It is inert and non-contaminating when in landfill.

The close interfitting of the container sections 14–20, with each succeeding lower edge being slightly larger in diameter than the inside diameter of the upper edge below, provides for a tight wedging of the telescoped sections when they are pulled upwardly relative to each other. In one embodiment of the invention, this wedging effect alone is relied upon to hold the container in the erect position shown in FIG. 1. However, FIG. 2 indicates a series of foldable locking flaps 32. These flaps may have an upper portion 34 which is laminated to the particular section (e.g. the section 20) where it is located, and this portion 34 can add to the structural integrity of the section, actually forming part of the thickness of the section and giving it stability. The locking flaps 32 can be provided at several locations around the section, or two or three flaps can be on each section in such a way that they contiguously or nearly contiguously encircle the section.

As indicated in FIG. 2, the locking flap 32 has a lower pivoted portion 36 which is up against the upper portion 34 when the container is opened, but which is folded down about a fold line 38 to a locking position, after the container has been fully erected. In this way, the flaps 34 prevent inadvertent collapsing of the telescoped container. In some embodiments of the invention, the folding flap or tab 36 can be folded back up against the upper portion 34 and the section may be manipulated so as to collapse it back into the next succeeding section below, for storage and later reuse of the container.

FIG. 3 shows an alternate embodiment of the container, wherein another type of structure is used to hold the container in the erected, telescoped position. A simple paper collar 40 may be included on each of the sections 20, 18 and 16, to abut against the upper edge of the next section below in the erect position and thus prevent inwardly telescoping. The collar 40, as shown in FIG. 3, is slightly larger in outside diameter than a bottom edge are 42 of the illustrated container section (the section 20).

The locking collar 40 may extend through only a portion of the section's height, as shown in FIG. 3, or it can extend through the entire height of the section above the bottom portion 42 of the section. In this way, the collar 40 can be of relatively thin paper, as can the material to which it is laminated, with the strength of the section derived from the combination of the two laminates.

As shown in FIG. 4, a large cap 44 may be provided for the closed, collapsed container, in addition to the mouth closure cap 22 illustrated in FIG. 1. The outer cap 44 forms a restraint from telescopic opening of the container when opening is not desired. The cap 44 can again be formed of a paper material, close-fitted and with or without adhesive holding it to the top of the lower section 14.

It should be understood that the caps or closures 44 and 22 can be formed in any suitable manner, from any suitable material. For example, a throw-away foil closure can be used in either or both cases, sealed to each rim in the manner which is common to certain beverages such as orange juice.

Figure 5:
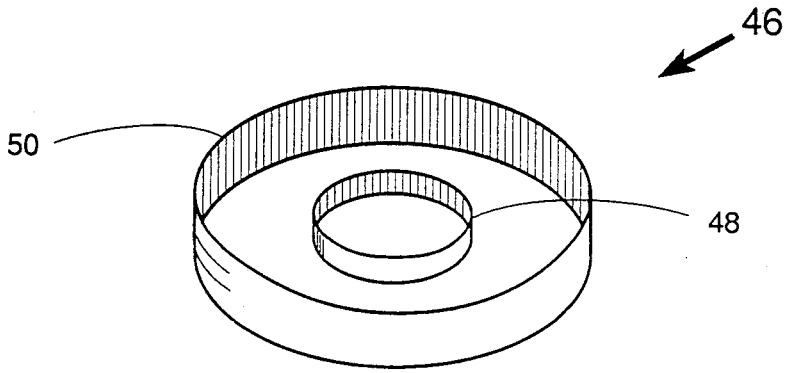
FIG. 5 is a view showing a closure which can be used on the collapsed container.

FIG. 5 shows an alternative type of closure or cap 46 that shows the underside of an alternative type of cap or closure 46, which has an inner rim 48 and an outer rim 50, for closing both the lower section 14 and the inner, top open mouth 12 when the container is in the collapsed position shown in FIG. 4.

Figure 6:
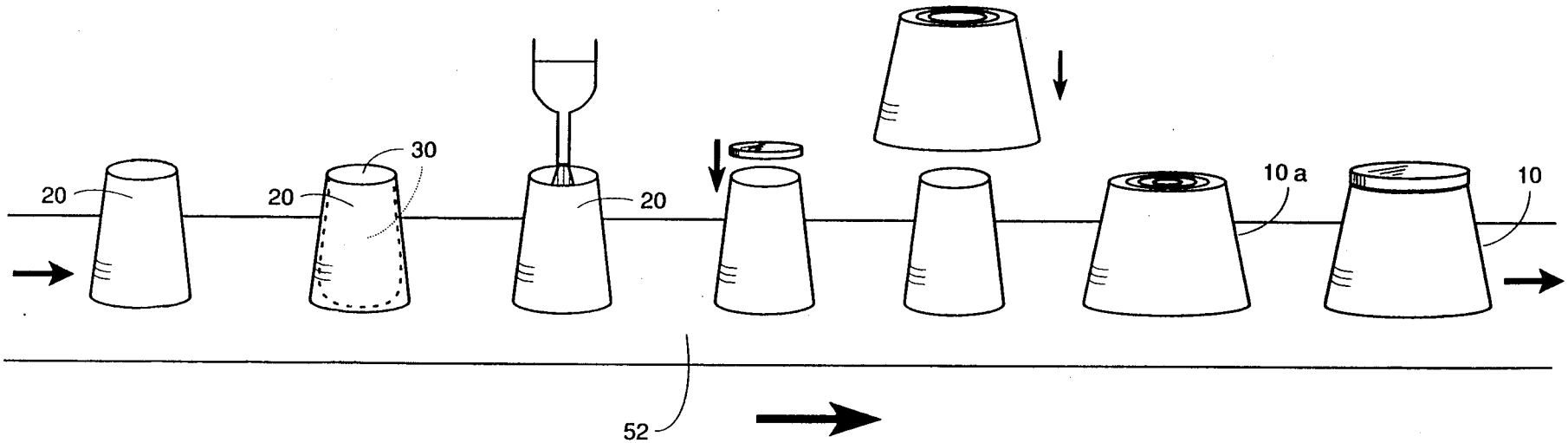
FIG. 6 is a schematic diagram showing an example of a series of steps by which the container of the invention can be assembled.

FIG. 6 is a schematic diagram illustrating an example of a procedure which can be used to assemble a container 10 in accordance with the invention.

As shown in FIG. 6, in assembly of one embodiment of the container the uppermost section 20 (already formed in another process) can have the plastic liner 30 inserted and sealed to its top opening, as a first step. Next, for applications in which the container is to hold a concentrate, the liquid or powder concentrate may be added into the liner or bag 30, as schematically indicated. The addition of concentrate could be performed before the bag is inserted and sealed to the top section 20, provided the liner is then handled carefully in securing it to the top section 20.

As a next step, the cap 22 (or another suitable form of closure as described above) can be applied to and temporarily sealed to the top of the top container section 20. After this has been accomplished the plastic liner and its contents are sealed, although the liner is not supported at its bottom side other than by a conveyor belt 52 or other form of conveyance used in the process.

In a succeeding step the lower sections are placed down over the uppermost section—first the next succeeding lower section 18, then the section 16 and finally the lowermost section 14 (or all of the larger sections 14, 16 and 18 could be preassembled and placed together over the top section 20. This assembly is shown at 10*a* in FIG. 6. A further closure cap such as the cap 44 (FIG. 4) can then be placed over the top of this assembly to close the top of the lowermost section 14 (or a double-ring cap 46 as in FIG. 5 can be used for both closures). If the lowermost section 14 has a bottom comprising a series of inwardly folded tabs 28 such as shown in FIG. 1, the bottom section can be placed down over the other three sections with these tabs extending generally cylindrically outwardly. Then a handling device can lift the assembly, maintaining the inner container sections in place, and fold the tabs 28 inwardly to form the bottom. These tabs 28 can then be adhered together by adhesive or mechanical means, if needed. However, if the tabs are formed with connecting webs between them they can be snapped "over center" to remain nestled together as a full or partial bottom.

The assembled, collapsed container 10 is then put through any final labelling steps as desired, and the container is ready for distribution and use.

The above described preferred embodiment is intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A collapsible container, comprising, a plurality of tapered, hollow truncated conical sections fitted together, each having a base and an upper end, with the upper end of one section having a slightly smaller inside dimension than an outside dimension of the base end of the succeeding section above, and with each section tapering to a smaller dimension at its top, such that the sections can be collapsed together to a height generally the same as that of the lowermost section and the sections can be telescopically opened by pulling upwardly on the uppermost section to form a telescopically expanded container, a plastic liner connected to and extending interiorly of the uppermost section, means providing an opening at the upper end of the uppermost section, the opening being open to the interior of the plastic liner, so that a user of the container can drink liquid contents of the liner from the top of the container, and means associated with the plurality of sections for holding the sections in the open, telescoped position.

2. A container according to claim 1, wherein the means for holding the container in the open position comprises a series of foldable tabs, at least one on each section above the lowermost section, for engaging against an edge of the section immediately below so as to keep the sections from collapsing together.

3. A container according to claim 1, wherein the sections are formed of biodegradable paper.

4. A container according to claim 3, wherein the plastic liner is formed of a polyethylene film.

5. A container according to claim 1, wherein the plastic liner is formed of a polyethylene film.

6. A container according to claim 1, wherein the plastic liner has an open mouth extending a short distance out of the opening at the upper end of the uppermost section, with the edge of the open mouth secured and sealed to the uppermost section adjacent to the opening.

7. A method for forming a container for liquids, comprising, forming a plurality of hollow truncated conical sections, each succeeding section being smaller than the section immediately below, with an inner diameter of the section immediately below being slightly smaller than the outer diameter of the bottom edge of the section immediately above, inserting a lightweight plastic film liner into the uppermost section and sealing a mouth of the liner to an upper open end or mouth of the uppermost section, placing over the uppermost section the remaining, larger sections generally concentrically, so that an assembly is formed with each succeeding section inside the section which is to be immediately below when the container is erected, and providing some means of restraint at the bottom of the lowermost section, for restraining the contained other sections from falling through the bottom of the assembly.

8. The method according to claim 7, further including the step of adding a powder or liquid concentrate to the plastic liner and then placing a cap onto the mouth of the uppermost section, so that an end user can telescopically erect the container and can open the top closure and simply add water or other liquid, to produce a beverage drinkable from the erected container.

9. The method of claim 7, further including adding a closure over the top of the lowermost container section after the sections have been assembled.

10. The method of claim 7, further including removing the closure from the lowermost container section, then pulling the sections relatively apart to telescope them outwardly and form an erected container.

* * * * *